US010522944B2

(12) United States Patent
Shinder-Lerner et al.

(10) Patent No.: US 10,522,944 B2
(45) Date of Patent: Dec. 31, 2019

(54) DISPOSABLE ELECTRICAL CONNECTOR HAVING A PRINTED CIRCUIT BOARD

(71) Applicant: Hypertronics Corporation, Hudson, MA (US)

(72) Inventors: Arkady Shinder-Lerner, Framingham, MA (US); Francesco A. Nania, Clinton, MA (US)

(73) Assignee: Smiths Interconnect Americas, Inc., Kansas City, KS (US)

( * ) Notice: Subject to any disclaimer, the term of this patent is extended or adjusted under 35 U.S.C. 154(b) by 0 days.

(21) Appl. No.: 15/780,594

(22) PCT Filed: Dec. 5, 2016

(86) PCT No.: PCT/US2016/064990

§ 371 (c)(1),
(2) Date: May 31, 2018

(87) PCT Pub. No.: WO2017/096389

PCT Pub. Date: Jun. 8, 2017

(65) Prior Publication Data

US 2018/0366875 A1 Dec. 20, 2018

Related U.S. Application Data

(60) Provisional application No. 62/263,509, filed on Dec. 4, 2015, provisional application No. 62/310,490, filed on Mar. 18, 2016.

(51) Int. Cl.
*H01R 13/631* (2006.01)
*H01R 12/71* (2011.01)
(Continued)

(52) U.S. Cl.
CPC ..... *H01R 13/631* (2013.01); *H01R 12/714* (2013.01); *H01R 13/6658* (2013.01);
(Continued)

(58) Field of Classification Search
CPC .... H01R 13/361; H01R 12/714; H01R 24/60; H01R 2107/00; H01R 13/748;
(Continued)

(56) References Cited

U.S. PATENT DOCUMENTS 6,099,354 A 8/2000 Troyan
8,535,102 B1 * 9/2013 Colahan ..... H01R 31/06 439/5

(Continued)

FOREIGN PATENT DOCUMENTS

JP 2011-526721 10/2011

*Primary Examiner* — Travis S Chambers
(74) *Attorney, Agent, or Firm* — Snell & Wilmer LLP

(57) ABSTRACT

An electrical connector comprising a first housing defining a cavity therein, a first printed circuit board disposed in the cavity of the first housing, a contact coupled with the first printed circuit board, a disposable second housing defining a cavity therein, and a second printed circuit board disposed in the cavity of the second housing, the second printed circuit board having a contact pad positioned on a surface of the second printed circuit board, the contact pad of the second printed circuit board configured to engage with the contact when the first housing and the second housing are mated together.

20 Claims, 4 Drawing Sheets

(51) Int. Cl.

| | |
|---|---|
| ***H01R 13/66*** | (2006.01) |
| *H01R 13/24* | (2006.01) |
| *H01R 13/74* | (2006.01) |
| *H01R 24/60* | (2011.01) |
| *H01R 107/00* | (2006.01) |
| *H01R 12/72* | (2011.01) |
| *H01R 13/64* | (2006.01) |

(52) U.S. Cl.
CPC ..... *H01R 12/721* (2013.01); *H01R 13/24* (2013.01); *H01R 13/64* (2013.01); *H01R 13/746* (2013.01); *H01R 13/748* (2013.01); *H01R 24/60* (2013.01); *H01R 2107/00* (2013.01)

(58) Field of Classification Search
CPC .. H01R 13/6658; H01R 13/64; H01R 12/721; H01R 13/746; H01R 13/24
USPC ..... 439/374, 638, 65
See application file for complete search history.

(56) References Cited

U.S. PATENT DOCUMENTS

| | | | | |
|---|---|---|---|---|
| 8,998,620 | B2 * | 4/2015 | Ni | H01R 12/71 361/737 |
| 2009/0104818 | A1 * | 4/2009 | Wu | H01R 12/716 439/638 |
| 2009/0277665 | A1 * | 11/2009 | Kumamoto | H01R 9/035 174/113 R |
| 2010/0304611 | A1 | 12/2010 | He et al. | |
| 2012/0264335 | A1 * | 10/2012 | Feyder | H01R 12/732 439/629 |
| 2013/0210273 | A1 | 8/2013 | Wu et al. | |
| 2013/0237092 | A1 * | 9/2013 | Rubens | H01R 13/6596 439/607.23 |
| 2014/0335709 | A1 * | 11/2014 | Chung | H01R 31/06 439/172 |
| 2015/0155657 | A1 * | 6/2015 | Golko | H01R 13/516 439/345 |

* cited by examiner

DISPOSABLE ELECTRICAL CONNECTOR HAVING A PRINTED CIRCUIT BOARD

CROSS REFERENCE TO RELATED APPLICATIONS

This application claims the benefit and priority of U.S. Provisional Application No. 62/263,509, entitled "Electrical Connector," filed on Dec. 4, 2015 and U.S. Provisional Application No. 62/310,490, entitled "Disposable Electrical Contact Having a Printed Circuit Board," filed on Mar. 18, 2016, the entire contents of both applications are hereby incorporated by reference herein.

BACKGROUND

1. Field

The present invention relates generally to mated pair connectors and improvements thereto and more particularly pertains to high density mated pair connectors utilizing a printed circuit board therein and improvements thereto.

2. Description of the Related Art

Electrical connectors for interfacing between separated systems or electronic devices are widely used in the art. Conventional electrical connectors utilize a series of pins on a first half of the connector and a corresponding series of sockets on a second half of the connector. When the two halves are mated together, the sockets receive the pins in order to electrically connect and provide a conductive pathway through the electrical connector. Thus, when a first system or electronic device is electrically coupled with the pins of the first half of the connector and a second system or electronic device is electrically coupled with the sockets of the second half of the connector, the two systems or devices may be electrically connected through the mated connector.

As systems and devices increase in complexity, the need has arisen for high density electrical connectors capable of electrically connecting increasingly large numbers of signals with one another. One type of electrical connector that has seen use in the electronic industry is a card edge connector. Conventional card edge connectors employ a slotted surface configured to couple or mate with an exposed edge of a printed circuit card or board. Electrically conductive surfaces on the exposed edge of the printed circuit card or board interface with a similarly situated row of electrical contacts in the slotted surface of the card edge connector.

A significant downside to such interfaces, however, results from the fact that card edge connectors require an exposed printed circuit board be incorporated in the utilizing application. Such a physical constraint is not viable for many new system designs. Moreover, not only do many current systems that would benefit from high density electrical connections not meet such a requirement, but modifying such systems to utilize these exposed electrical conductors can result in significant reliability and safety concerns. Conductive and potentially power-carrying electrical contacts must be left exposed to the surrounding, and potentially intrusive, outside environment. Not only does this exposure risk contamination or degradation of the electrical contacts over time due to weather or other contaminants in the air, but also exposes the conductive terminals of the system where a human being may accidentally come into contact with them. Electrical shock risks can be extremely dangerous if the system is capable of high current or voltage levels.

In addition, depending upon the configuration or orientation of the conductive surfaces on the exposed edge, a card edge connector may need to be specifically designed or independently manufactured for the specific circuit board utilized in the corresponding system. As such, card edge connectors may not be transferable between different customers or even for differing systems of the same customer, increasing the cost of their manufacturing due to the specialty nature of their construction. Such limited-use designs are particularly undesirable as systems increase in complexity and must respond to a larger number of signals since consumers have become ever more cost conscious when searching for suitable electrical interfacing for their growing systems. Therefore, a need exists for an improved high density electrical connector. Ideally, such an electrical connector would allow for a large number of signals to be propagated, would be inexpensive to manufacture, would be scalable, would be safe to use, and would provide sufficient protection against electrical interference or contaminants or degradation of the electrical contacts.

SUMMARY

A mated pair electrical connector utilizing a printed circuit board for providing a high density and low cost solution to facilitate an electrical connection therethrough is disclosed.

In one embodiment, an electrical connector may include a first housing defining a cavity therein and a first printed circuit board disposed in the cavity of the first housing. A contact is coupled with the first printed circuit board. In addition, the electrical connector may include a disposable second housing defining a cavity therein and a second printed circuit board disposed in the cavity of the second housing, the second printed circuit board having a contact pad positioned on a surface of the second printed circuit board, the contact pad of the second printed circuit board configured to engage with the contact when the first housing and the second housing are mated together.

In another embodiment, a connector for providing an electrical connection between a first conductor and a second conductor may include a non-disposable receptacle housing and a first circuit board coupled to the receptacle housing. The first circuit board may have a contact pad on the first circuit board. A contact is coupled to the receptacle housing and electrically connected with the contact pad. The connector may also include a disposable plug housing configured to mate with the receptacle housing and a second circuit board coupled to the plug housing. The second circuit board may have a contact pad on the second circuit board. The contact pad of the second circuit board may be configured to engage the contact when the receptacle housing and the plug housing are mated together.

BRIEF DESCRIPTION OF THE DRAWINGS

Other systems, methods, features, and advantages of the present invention will be or will become apparent to one with skill in the art upon examination of the following figures and detailed description. It is intended that all such additional systems, methods, features, and advantages be included within this description, be within the scope of the present invention, and be protected by the accompanying claims. Component parts shown in the drawings are not necessarily to scale, and may be exaggerated to better illustrate the important features of the present invention. In the drawings, like reference numerals designate like parts throughout the different views, wherein:

DETAILED DESCRIPTION

Figure 1:
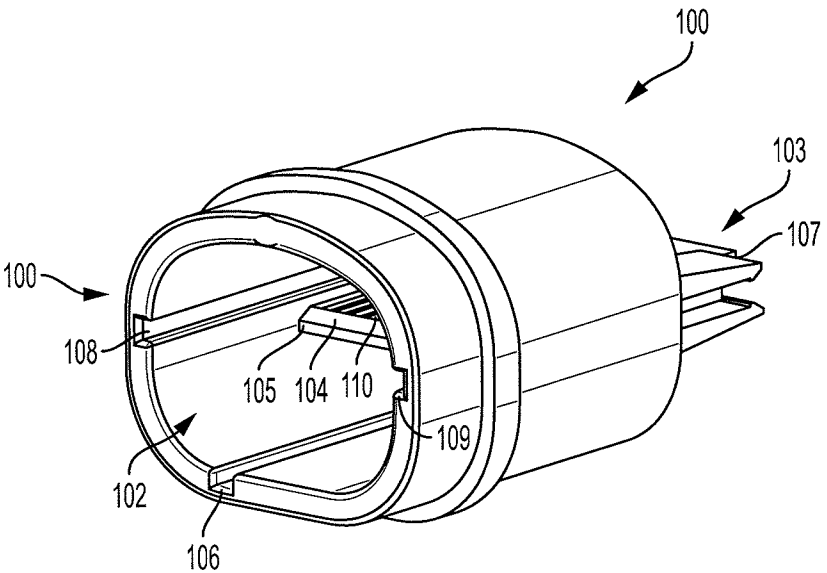
FIG. 1 is a perspective view of a plug housing of an electrical connector utilizing printed circuit boards in an unmated configuration according to an embodiment of the invention.

Referring first to FIG. 1, a plug housing 100 of an electrical connector is shown in an unmated configuration. The plug housing 100 has a receptacle mating end 101 and a rear end 103. The plug housing 100 defines a cavity 102 configured to house a printed circuit board (PCB) 104. The PCB 104 also has a contact pad 110 for facilitating electrical coupling. The PCB 104 may be housed such that a first end 105 of the PCB protrudes outwardly from the mating end 101, and a second end 107 of the PCB protrudes outwardly from the rear end 103. The plug housing 100 can also include grooves 108, 109 and a keying slot 106. In related versions, the plug housing 100 can be disposable.

Figure 2:
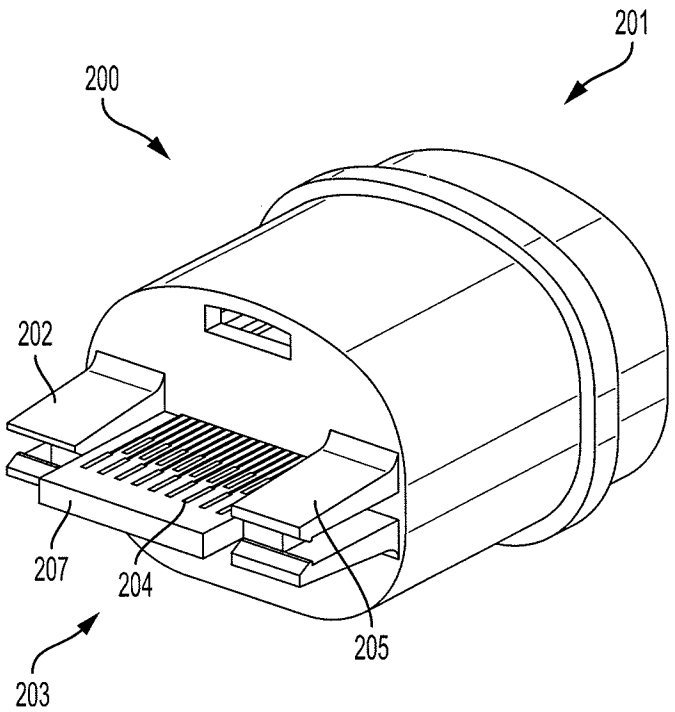
FIG. 2 is a perspective view of the plug housing of FIG. 1 according to an embodiment of the invention.

Referring to FIG. 2, a perspective view of a plug housing 200 of the electrical connector is shown in an unmated configuration. A rear end 203 can include prongs 202, 205 for securing the PCB 204 in a fixed orientation. In related versions, the PCB 204 can be housed such that a second end 207 of the PCB protrudes outwardly from the rear end 203. Mating with a receptacle housing (shown in FIGS. 3 and 4) is accomplished at receptacle mating end 201.

Figure 3:
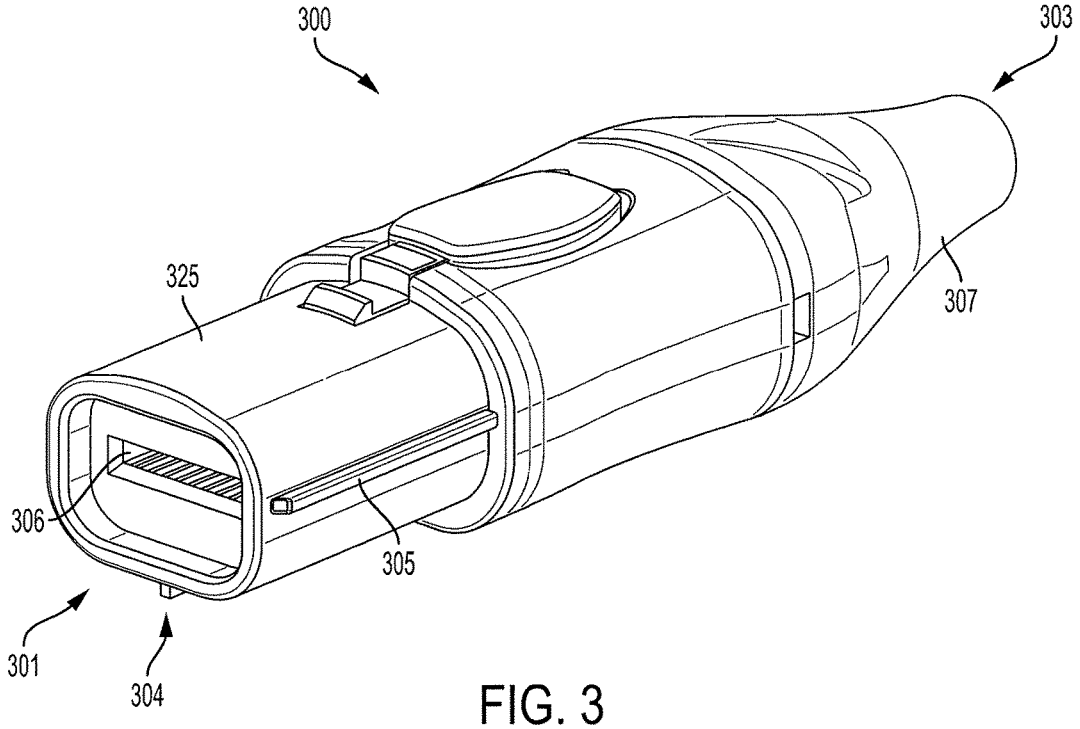
FIG. 3 is a perspective view of a receptacle housing of an electrical connector utilizing printed circuit boards in an unmated configuration according to an embodiment of the invention.
Figure 4:
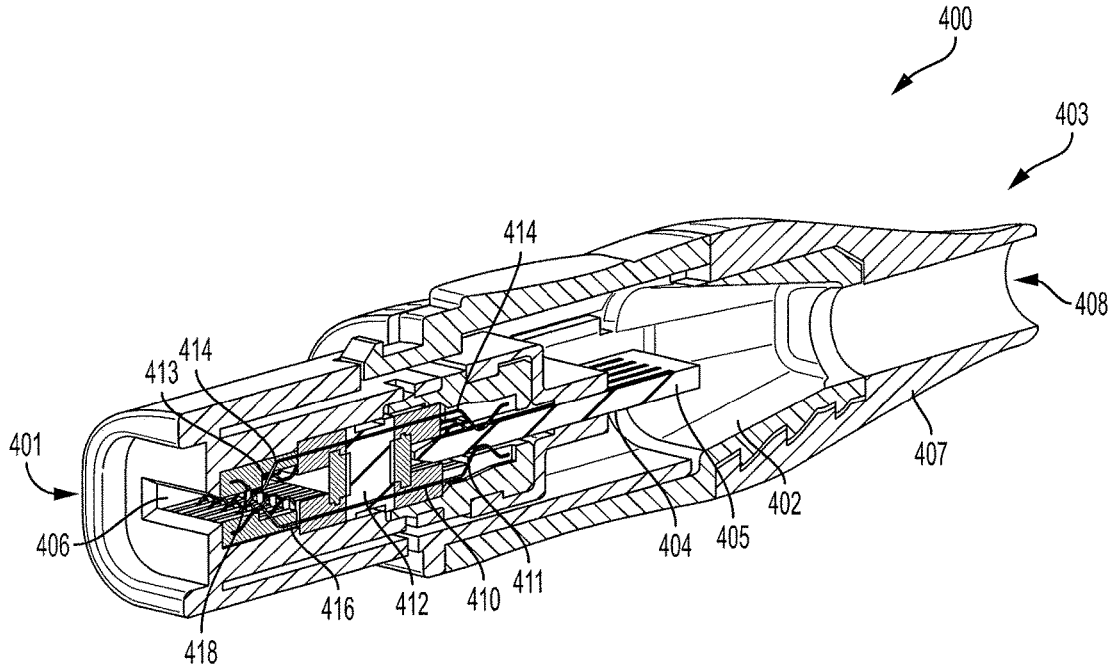
FIG. 4 is a cut-away perspective view of the receptacle housing of FIG. 3 according to an embodiment of the invention.

Referring to FIGS. 3 and 4, a receptacle housing 300, 400 of an electrical connector is shown in an unmated configuration. The receptacle housing 300, 400 has a receptacle mating end 301, 401 and a rear end 303, 403. The mating end 301 includes a mating aperture 306, 406 for mating with a PCB of a plug housing. The mating end 301 also includes protrusions 305 and 325 configured to slidably engage with grooves in a plug housing. In related versions, the mating end 301 can further include a keying protrusion 304 configured to slidably engage with a keying groove in a plug housing, such that the plug and receptacle housings can only mate in one orientation. In related versions, the rear end 303, 403 can include a contoured (e.g., cone shaped) section 307, 407 for facilitating coupling to cabling. For example, contoured (e.g., cone shaped) section 307, 407 can include a cabling aperture 408 for receiving cabling. The contoured (e.g., cone shaped) shape is advantageous to provide strain relief to cabling.

Referring now to only FIG. 4, a cut-away perspective view of the receptacle housing 400 is shown. The receptacle housing 400 defines a cavity 402 configured to house a PCB 404 having a contact pad 405. The PCB 404 is coupled to a contact 410. The contact 410 is held in place by a contact module 412, so that the contact 410 is in a predetermined orientation when mating with a plug housing. The contact 410 can have a first side 411 and a second side 413. The PCB 404 can be coupled to the contact 410 at the first side 411, and a PCB of a plug housing can be coupled to the contact at the second side 413, resulting in electrical coupling of the receptacle PCB 404 to a plug PCB. The contact can be made of any electrically conductive material known in the art, such as copper metals and other alloys.

In related versions, the contact 410 has a curved portion 414, the curved portion 414 of the contact 410 is configured to engage with the contact pad 110 of the PCB 104 when the receptacle housing 400 and the plug housing 100 are mated together. For example, both the first side 411 and the second side 413 can have curved portions 414.

In related versions, a contact module holder 416 is coupled to the receptacle housing 400, such that the contact module holder 416 is also coupled with the contact module 412. The receptacle housing 400 thus supports the contact module holder 416 while the contact module holder 416 supports the contact module 412.

In related versions, the contact module holder 416 includes a contact pocket 418, the contact 410 of the contact module 412 at least partially received by the contact pocket 418 when the contact module 412 is coupled with the contact module holder 416.

Figure 5:
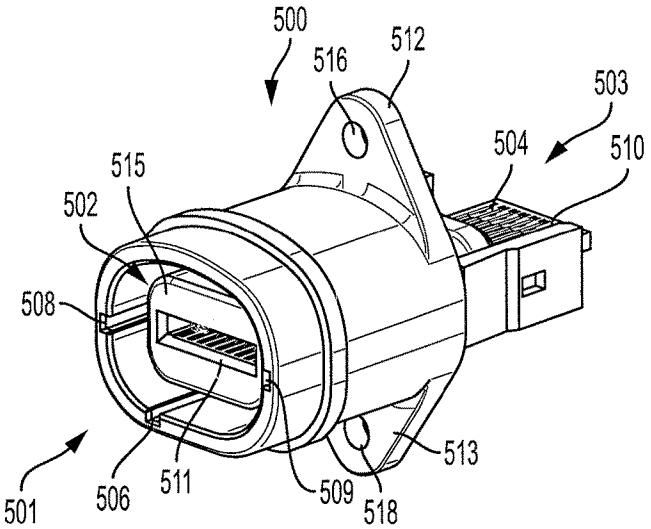
FIG. 5 is a perspective view of a receptacle housing of an electrical connector utilizing printed circuit boards in an unmated configuration according to an embodiment of the invention.

Referring to FIG. 5, a perspective view of a version of a receptacle housing 500 is shown. The receptacle housing 500 is shaped similarly to the plug housing 100, except that the receptacle housing 500 is configured to receive a PCB for coupling from a plug housing, rather than to provide a PCB for coupling.

The receptacle housing 500 has a receptacle mating end 501 and a rear end 503. The plug housing 500 defines a cavity 502 configured to house a printed circuit board (PCB) 504 and a receptacle aperture 511. The PCB 504 may be housed such that the PCB 504 protrudes outwardly from the rear end 503. The receptacle aperture 511 can be defined in a receptacle aperture assembly 515. The PCB 504 also has a contact pad 510 for facilitating electrical coupling. The plug housing 500 can also include grooves 508, 509 and a keying slot 506. Attachment fins 512, 513 can facilitate attachment of the receptacle housing 500 to additional components (not shown). The attachment fin 512 can define aperture 516 and the attachment fin 513 can define aperture 518, for use with a screw, nail, or other attachment means known in the art.

Figure 6:
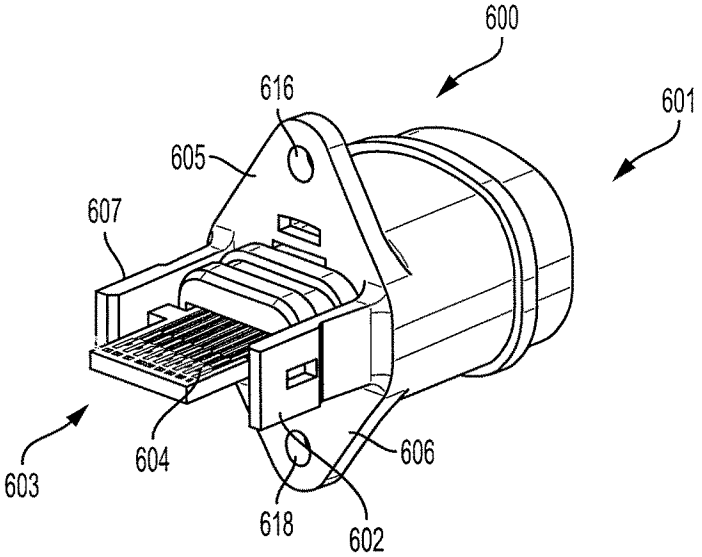
FIG. 6 is a perspective view of the receptacle housing of FIG. 5 according to an embodiment of the invention.

Referring to FIG. 6, a perspective view of a receptacle housing 600 of FIG. 5 is shown in an unmated configuration. A rear end 603 can include prongs 602, 607 for securing a PCB 604 in a fixed orientation. In related versions, the PCB 604 can be housed such that the PCB 604 protrudes outwardly from the rear end 603. Mating with a plug housing (shown in FIGS. 8 and 9) is accomplished at the receptacle mating end 601. In related versions, the receptacle housing 600 can also include the attachment fins 605, 606 for facilitating attachment of the receptacle housing 600 to additional components (not shown). The attachment fin 605 can define the aperture 616 and the attachment fin 606 can define the aperture 618, for use with a screw, nail, or other attachment means.

Figure 7:
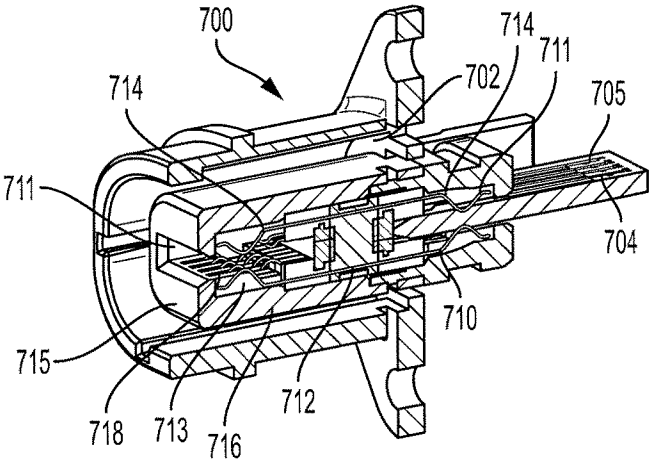
FIG. 7 is a cut-away perspective view of the receptacle housing of FIG. 6 according to an embodiment of the invention.

Referring to FIG. 7, a cut-away perspective view of a receptacle housing 700 of FIGS. 5 and 6 is shown. The receptacle housing 700 defines a cavity 702 configured to house a PCB 704 having a contact pad 705 and a receptacle aperture assembly 715 defining a receptacle aperture 711. The PCB 704 is coupled to a contact 710. The contact 710 is held in place by a contact module 712, so that the contact 710 is in a predetermined orientation when mating with a plug housing. The contact 710 can have a first side 711 and a second side 713. The PCB 704 can be coupled to the contact 710 at the first side 711, and a PCB of a plug housing can be coupled to the contact at the second side 713, resulting in electrical coupling of the receptacle PCB 704 to a plug PCB. The contact can be made of any electrically conductive material known in the art, such as copper metals and other alloys.

In related versions, the contact 710 has a curved portion 714, the curved portion 714 of the contact 710 is configured to engage with a contact pad of a plug PCB when the receptacle housing 700 and the plug housing are mated together. For example, both the first side 711 and the second side 713 can have curved portions 714.

In related versions, a contact module holder 716 is coupled to the receptacle housing 700, such that the contact module holder 716 is also coupled with the contact module 712. The receptacle housing 700 thus supports the contact module holder 716 while the contact module holder 716 supports the contact module 712.

In related versions, the contact module holder 716 includes a contact pocket 718, the contact 710 of the contact module 712 at least partially received by the contact pocket 718 when the contact module 712 is coupled with the contact module holder 716.

Figure 8:
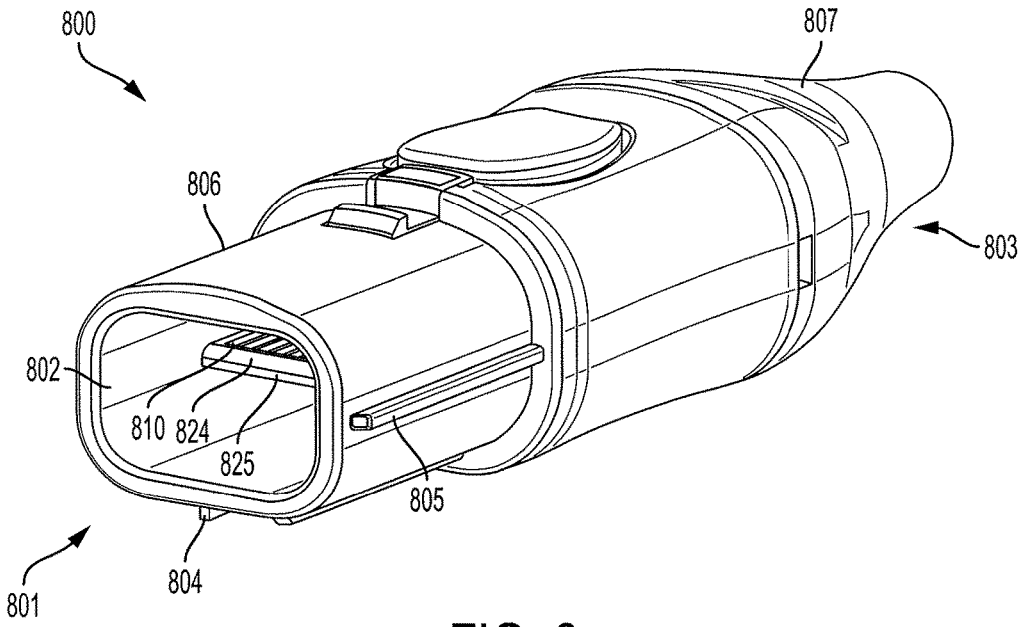
FIG. 8 is a perspective view of a plug housing of an electrical connector utilizing printed circuit boards in an unmated configuration according to an embodiment of the invention.

Referring to FIG. 8, a plug housing 800 of an electrical connector is shown in an unmated configuration. The plug housing 800 is similar in appearance to receptacle housings 300, 400 as shown above in FIGS. 3 and 4, and configured to mate with the receptacle housing 500, 600, and 700 as shown above in FIGS. 5-7. The plug housing 800 has a plug mating end 801 and a rear end 803. The plug housing 800 defines a cavity 802 configured to house a printed circuit board (PCB) 824. The PCB 824 also has a contact pad 810 for facilitating electrical coupling. The PCB 824 may be housed such that a first end 825 of the PCB protrudes outwardly from the mating end 801, and a second end of the PCB (shown in FIG. 9) protrudes outwardly from the rear end 803. In related versions, the plug housing 800 can be disposable.

In related versions, the mating end 801 includes protrusions 805 and 806 configured to slidably engage with grooves 508 and 509 in the receptacle housing 500. In related versions, the mating end 801 can further include a keying protrusion 804 configured to slidably engage with the keying groove 506 in the receptacle housing, such that the plug and receptacle housings can only mate in one orientation. In related versions the rear end 803 can include a contoured section 807 for facilitating coupling to cabling. The contoured shape is advantageous to provide strain relief to cabling.

Figure 9:
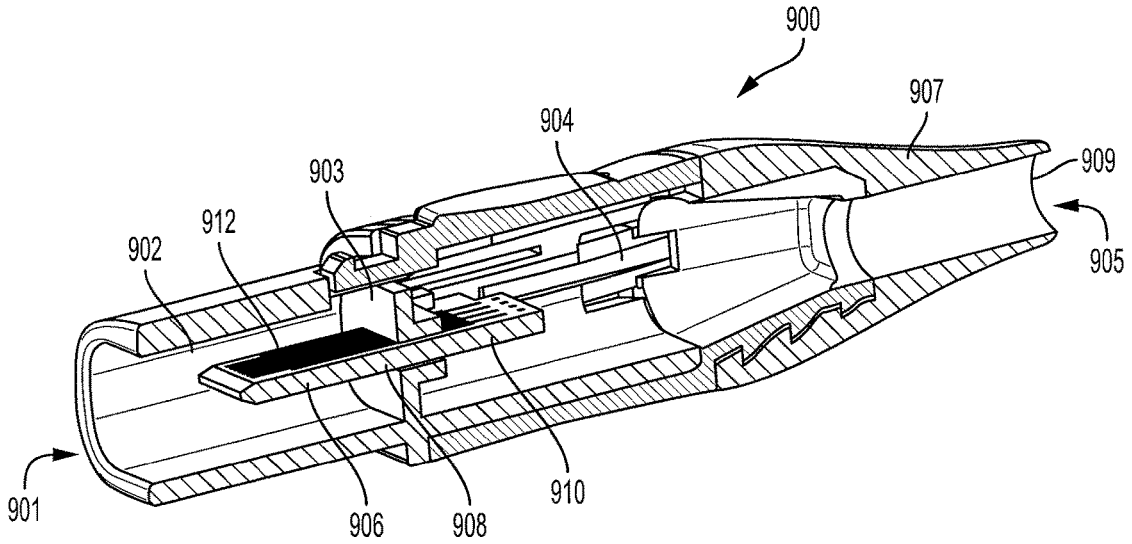
FIG. 9 is a cut-away perspective view of the plug housing of FIG. 8 according to an embodiment of the invention.

Referring to FIG. 9, a cut-away view of a plug housing 900 of FIG. 8 is shown in an unmated configuration. Plug housing 900 defines a front cavity 902 at a mating end 901, and a rear cavity 904 at a rear end 905. The front cavity 902 and the rear cavity 904 are divided by a PCB holder 903. The front cavity 902 houses a front portion 906 of a PCB 908. The rear cavity 904 houses a rear portion 910 of the PCB 908. The PCB 908 is held in place in a predetermined orientation by the PCB holder 903. The PCB 908 includes contact pad 912 for coupling with a contact in a receptacle housing. The plug housing 900 can also include a contoured section 907 for facilitating coupling to cabling. For example, the contoured section 907 can include the cabling aperture 909. The contoured shape is advantageous to provide strain relief to cabling. In related versions, the plug housing 909 is disposable.

Referring to FIGS. 1-9, in operation, the plug housings and the receptacle housings are configured to mate with each other at their respective mating ends. Upon mating, the plug PCBs become electrically coupled to the receptacle PCBs through the contact. The electrical coupling is secured by the curved portions of the contact. The grooves slidably engage and disengage from the protrusions to allow mating in only one orientation. This allows for simple and quick coupling and decoupling of a plurality of PCBs without the need for use of more permanent conventional means of creating electrical connections, such as soldering.

For a first version (shown in FIGS. 1-4), the plug housing is short with an exposed rear section of the PCB, and the receptacle housing is elongate with a contoured portion at its rear section. For a second version (shown in FIGS. 5-9), the receptacle housing is short with an exposed rear section of the PCB, and the plug housing is elongate with a contoured portion at its rear section. Regardless of which versions of the plug housing and receptacle housing are used, the plug housing can be disposable whereas the receptacle housing can be non-disposable. The main difference between the different versions of the plug housing and receptacle housing is in the shape of the casing. The interior configuration of the plug housing and the receptacle housing remains substantially the same regardless of which versions.

Although the embodiments previously described have shown various connector components as integrated or coupled to a plug assembly or a receptacle assembly, the gender of each assembly may be reversed or certain features of the plug assembly may be incorporated into the receptacle assembly and vice versa in an embodiment. An embodiment may also utilize greater or fewer connector components than have been described for the embodiments above. In one example, electrical contacts, contact modules, and/or contact module holders may be incorporated as part of a receptacle connector assembly and be configured to slidably mate with a printed circuit board of a plug assembly. In another example, only one of a plug assembly or a receptacle assembly may utilize a printed circuit board therein. In another example, the electrical connectors are ECLIPTA connectors.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. An electrical connector comprising:

a first housing defining a cavity therein;

a first printed circuit board disposed in the cavity of the first housing;

a contact coupled with the first printed circuit board;

a disposable second housing defining a cavity therein and having a mating end and a rear end opposite the mating end, and prongs extending away from the mating end; and a second printed circuit board having a first end and a second end opposite the first end, the first end being disposed within the cavity of the second housing, the second end protruding through the rear end of the second housing such that the prongs of the disposable second housing secure the second printed circuit board in a fixed orientation, the second printed circuit board having a contact pad positioned on the first end and configured to engage with the contact when the first housing and the second housing are mated together.

2. The electrical connector of claim 1 wherein the contact has a curved portion, the curved portion of the contact configured to engage with the contact pad when the first housing and the second housing are mated together.

3. The electrical connector of claim 1 further comprising a contact module including the contact and coupled with the first housing for holding the contact in a predetermined orientation with the first housing.

4. The electrical connector of claim 3 further comprising a contact module holder coupled to the first housing, the contact module holder coupled with the contact module.

5. The electrical connector of claim 4 wherein the contact module holder includes a contact pocket, the contact of the contact module at least partially received by the contact pocket when the contact module is coupled with the contact module holder.

6. The electrical connector of claim 1 wherein the first housing comprises a contoured end section.

7. The electrical connector of claim 6 wherein the first housing comprises protrusions configured to slidably engage with grooves on the second housing.

8. The electrical connector of claim 1 wherein the second housing comprises a contoured end section, and the second housing comprises protrusions configured to slidably engage with grooves on the first housing.

9. The electrical connector of claim 8 wherein the first housing has a first housing mating end configured to mate with the mating end of the disposable second housing and a cone-shaped rear end having a cabling aperture configured to receive at least one cable.

10. A connector for providing an electrical connection between a first conductor and a second conductor, the connector comprising:

a non-disposable receptacle housing having a mating end and a rear end opposite the mating end;

a first circuit board having a first end and a second end opposite the first end, the first end being disposed within the receptacle housing, the second end protruding through the rear end and having a contact pad;

a disposable plug housing defining a cavity therein and configured to mate with the receptacle housing, the disposable plug housing having a mating end, a rear end opposite the mating end, and prongs extending away from the mating end;

a second circuit board coupled to the disposable plug housing and having a contact pad positioned at least partially within the cavity of the plug housing and a second end protruding through the rear end of the second housing such that the prongs of the disposable plug housing secure the second circuit board in a fixed orientation; and a contact positioned within the receptacle housing and electrically connected with the contact pad of the first circuit board, the contact being configured to electrically connect the contact pad of the second circuit board to the contact pad on the first circuit board when the receptacle housing the plug housing are mated together.

11. The connector of claim 10 wherein the contact has a curved segment, the curved segment of the contact configured to engage with the contact pad of the second printed circuit board when the receptacle housing and the plug housing are mated together.

12. The connector of claim 10 wherein the receptacle housing and the plug housing are configured to mate in only one orientation.

13. The connector of claim 12 further comprising a keying slot in the receptacle housing or the plug housing for ensuring the receptacle housing and the plug housing can mate in only one orientation.

14. The connector of claim 10 wherein the receptacle housing comprises a contoured end section.

15. The connector of claim 14 wherein the receptacle housing comprises protrusions configured to slidably engage with grooves on the plug housing.

16. The connector of claim 10 wherein the plug housing comprises a contoured end section.

17. The connector of claim 16 wherein the plug housing comprises protrusions configured to slidably engage with grooves on the receptacle housing.

18. The connector of claim 10 further comprising a contact module including the contact and coupled with the receptacle housing for holding the contact in a predetermined orientation with the receptacle housing.

19. The connector of claim 18 further comprising a contact module holder coupled to the receptacle housing, the contact module holder coupled with the contact module.

20. The electrical connector of claim 19 wherein the contact module holder includes a contact pocket, the contact of the contact module at least partially received by the contact pocket when the contact module is coupled with the contact module holder.

* * * * *